US005708583A

United States Patent [19]

Solenne et al.

[11] Patent Number: 5,708,583

[45] Date of Patent: Jan. 13, 1998

[54] SYSTEM FOR DETERMINING THE POSITION AND ROLL ANGLE OF A MOVING BODY

[75] Inventors: Thierry Solenne, Bures-Sur-Yvette; Jean-Pierre Merle, Orsay, both of France

[73] Assignee: Aerospatiale Societe Nationale Industrielle, Paris, France

[21] Appl. No.: 632,074

[22] Filed: Apr. 15, 1996

[30] Foreign Application Priority Data

Apr. 24, 1995 [FR] France ..... 95 04868

[51] Int. Cl.[6] ..... F41G 7/26

[52] U.S. Cl. ..... 364/424.013; 364/423.098; 364/424.012; 244/3.16

[58] Field of Search ..... 364/423.098, 424.012, 364/424.013; 244/3.11, 3.13, 3.14, 3.15, 3.16, 3.17; 356/139.03

[56] References Cited

U.S. PATENT DOCUMENTS

| | | | |
|---|---|---|---|
| 3,772,516 | 11/1973 | Roberts et al. | 250/201 |
| 3,868,883 | 3/1975 | Tucker | 89/1.8 |
| 3,963,195 | 6/1976 | Coxe et al. | 244/3.11 |
| 4,072,281 | 2/1978 | Miller et al. | 244/3.16 |
| 4,470,562 | 9/1984 | Hall et al. | 244/3.2 |
| 4,710,028 | 12/1987 | Grenier et al. | 356/375 |
| 5,039,029 | 8/1991 | Taylor et al. | 244/3.11 |
| 5,196,645 | 3/1993 | Wisshaupt | 102/213 |
| 5,276,632 | 1/1994 | Corwin et al. | 364/578 |
| 5,372,334 | 12/1994 | Cuadros | 244/3.11 |
| 5,490,643 | 2/1996 | Jano et al. | 244/3.11 |
| 5,601,255 | 2/1997 | Romer et al. | 244/3.13 |

FOREIGN PATENT DOCUMENTS

| | | |
|---|---|---|
| 0206912 | 12/1986 | European Pat. Off. . |
| 0313246 | 4/1989 | European Pat. Off. . |

*Primary Examiner*—Kevin J. Teska
*Assistant Examiner*—Stephen J. Walder, Jr.
*Attorney, Agent, or Firm*—Fisher, Christen & Sabol

[57] ABSTRACT

The present invention relates to a system for determining the roll angle (ϕ), as well as the position with respect to an axis (OX), of a moving body (2), said system (1) having an optical detector (3). According to the invention, said system (1) includes:

three optical elements (8, 9, 10) mounted on said moving body (2) and capable of generating light flashes (7), two of said elements (8, 9) being mounted so as to be diametrically opposed and the third element (10) being arranged so as to be perpendicular to these two elements; and a computer (4) determining the position and roll angle of the moving body (2) from the position of said optical elements in a picture.

4 Claims, 2 Drawing Sheets

SYSTEM FOR DETERMINING THE POSITION AND ROLL ANGLE OF A MOVING BODY

The present invention relates to a system for determining the position and roll angle of a moving body.

It is particularly, although not exclusively, well suited to the locating and guiding of missiles, especially rotationally driven missiles.

In order to guide a missile undergoing rotational movement about its longitudinal axis with respect to a reference axis, for example the line of sight of a weapon system which has launched said missile, guidance devices are actuated, for example gas-generating lateral thrusters, jet interceptors or control surfaces, for suitable periods of time and at defined instants, that is to say for defined positions of said guidance devices with respect to said reference axis.

Consequently, it is necessary, in order to guide such a missile, to know:

on the one hand, the position of the missile with respect to said reference axis; and on the other hand, the roll angle of the missile, making it possible to determine the position of said guidance devices arranged at defined locations on said missile.

In general, the position and the roll angle are determined independently of each other.

Many methods are known for determining the position of a moving body with respect to a reference axis, such as, for example, that disclosed by the Applicant's patent FR-2,583,523.

The determination of the roll angle is generally more difficult to accomplish and it often requires expensive additional means.

In a known manner, the roll angle may be determined from a measurement carried out on board the missile, for example an inertial measurement. However, such a solution requires putting expensive, sophisticated and generally fragile equipment on board.

This is why the measurements necessary for determining the roll angle are generally carried out from the ground, especially for low-cost missiles.

For this purpose, a known solution advocates arranging on said missile an optical device, which includes a catadioptric component and a polarizer, and illuminating this optical device from the ground. The radiation reflected by said optical device is then detected on the ground and is processed so as to extract therefrom the roll angle of said missile.

However, using this method, there remains a 180° ambiguity in the value of the roll angle determined. It is then necessary to provide additional means to remove this indeterminacy, like those, for example, proposed by European Patents EP-0,485,292 and EP-0,628,782, which further increases the cost of implementing this solution.

The object of the present invention is to overcome these drawbacks. It relates to an accurate and low-cost system making it possible to determine both the roll angle and the position with respect to a reference axis of a moving body.

For this purpose, said system, which includes a stationary optical detector capable of taking a picture of the area around said reference axis in which said moving body is likely to move, is noteworthy, according to the invention, in that it includes:

three optical elements mounted on said moving body and capable of generating light flashes in the direction of said optical detector, a first and a second of said optical elements, forming a baseline, being mounted so as to be diametrically opposed with respect to said longitudinal axis and the third optical element being arranged on a line at least substantially perpendicular to this baseline passing through said longitudinal axis; and a computer linked to said optical detector and capable of determining the position and roll angle of said moving body from the position of said optical elements in a picture taken by said optical detector which detects said light flashes, said roll angle corresponding to the angle between said baseline and one axis of a defined reference-axis system, the ambiguity of 180° in said roll angle being removed by the position of the third optical element, and the position of said moving body with respect to said reference axis being obtained from the projection of the position of said third optical element on said baseline.

Thus, by virtue of the invention, it is possible to determine, simultaneously, the position with respect to said reference axis and the roll angle of said moving body from a single picture.

In addition, the invention is inexpensive to implement since most of the elements of the system in accordance with the invention, except for the optical elements of course, already exist on a moving-body guidance system, with which the system in accordance with the invention is generally combined.

Advantageously, when said moving body has four fins uniformly distributed over its periphery, as is the case for many types of missiles, the optical elements are arranged at the radially external ends, respectively, of three of the said fins.

Such an arrangement enables the optical elements to be as far away from the longitudinal axis of the moving body as possible and thus enables said optical elements, as well as the light flashes generated, to be protected from disturbances which might arise from any smoke produced at the rear of said moving body in the vicinity of its longitudinal axis while said moving body is being propelled, as is the case for certain types of missiles.

Moreover, according to the invention, the optical elements used may advantageously be produced in various ways.

Thus, in a first embodiment, said optical elements are simply light-flash emitters, for example beacon lights, while, in a second embodiment, the system in accordance with the invention includes a light-flash generator stationarily mounted in the vicinity of said optical detector and capable of emitting light flashes, at least in the area around said reference axis, and said optical elements are light reflectors capable of reflecting the light flashes received from said light-flash generator.

The figures of the appended drawing will make it clearly understood how the invention may be realized. In these figures, identical references designate similar elements.

Figure 1:
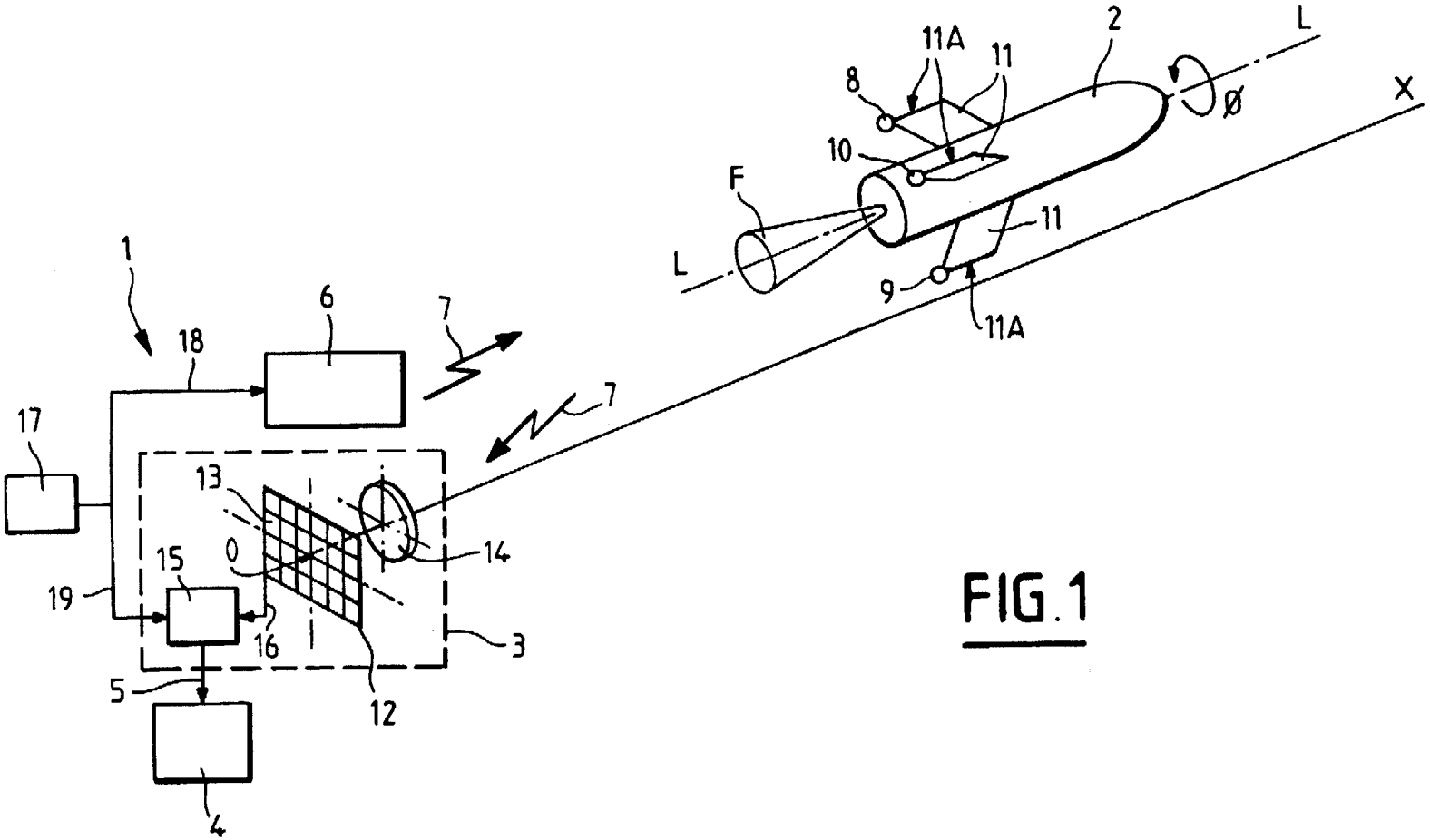
FIG. 1 shows diagrammatically the system in accordance with the invention, associated with a moving body.

The system 1 in accordance with the invention, shown in FIG. 1, is intended for continuously determining the roll angle, as well as the position with respect to a reference axis OX, of a moving body 2, in this case a missile.

The reference axis OX represents, for example, the line of sight of a weapon system, not shown, for example an anti-tank system, equipped with the system 1 in accordance with the invention and aimed at a target, not shown, which is to be reached by said missile 2.

The data determined by the system 1 and supplied to the weapon system may, especially, be used to formulate guidance orders which are intended to guide the missile 2 along said reference axis OX.

According to the invention, said system 1 includes:

an optical detector 3 stationarily mounted, for example in said weapon system;

a computer 4 linked to said optical detector 3 via a link 5;

a generator 6 generating light flashes 7 and stationarily mounted, in the vicinity of said optical detector 3, for example also in said weapon system; and three optical elements 8, 9, 10 mounted on said missile 2.

Said optical elements 8, 9 and 10 represent light reflectors which are arranged according to the invention in a special way on said missile 2, namely, more precisely:

the optical elements 8 and 9 are arranged so as to be diametrically opposed with respect to the longitudinal axis L—L of said missile 2, which has a cylindrical shape, said optical elements 8 and 9 defining a baseline LB shown in FIG. 2 and specified below; and the optical element 10 is arranged on a perpendicular PE to said baseline LB passing through said longitudinal axis L—L.

Said optical elements 8, 9 and 10 are intended to reflect, back to the optical detector 3, the light flashes 7 received from said generator 6.

When the missile 2 has four fins 11 uniformly distributed over its periphery, said optical elements 8, 9 and 10 are preferably arranged at the radially external ends 11A of three of said fins 11, as shown in FIG. 1.

This arrangement makes it possible to prevent the smoke F, or possibly a flame, produced at the rear of the missile 2 as it is being propelled, in the vicinity of the axis L—L, from disturbing said light flashes 7 before and/or after they are reflected off the optical elements 8, 9 and 10.

Said light flashes 7 emitted by the generator 6 and reflected by the optical elements 8, 9 and 10 are detected by the optical detector 3.

For this purpose, said optical detector 3, which represents for example a camera operating in the visible or infrared, includes, in a known manner:

a plane matrix 12 of photosensitive elements 13, for example of the charge-coupled type, which is perpendicular to the reference axis OX;

an optical means 14 capable of forming the image of the area around said reference axis OX on said matrix 12; and an electronic means 15 linked via a link 16 to said matrix 12 and capable of taking pictures PI of said area.

In a first embodiment, not shown, said generator 6 illuminates said optical elements 8, 9 and 10 continuously, which enables a picture to be taken at any instant, since the optical elements 8, 9 and 10 therefore continuously reflect the light received.

However, in a second embodiment, synchronization is preferably provided between the generation of the light flashes 7 by the generator 6 and the taking of the picture by the electronics 15.

For this purpose, the system 1 includes a control unit 17 which is linked via links 18 and 19, respectively, to the generator 6 and to the electronics 15 and which controls this generator and these electronics simultaneously.

Said control unit 17 may, in particular:

either be actuated by a person using the system 1 in accordance with the invention, when he desires to know the position and roll angle of the missile 2;

or include a clock which actuates said control unit 17 at regular time intervals.

The light flashes 7 detected by the optical detector 3 are capable of activating the photosensitive elements 13 of the matrix 12 and therefore can be identified in a picture PI.

Figure 2:
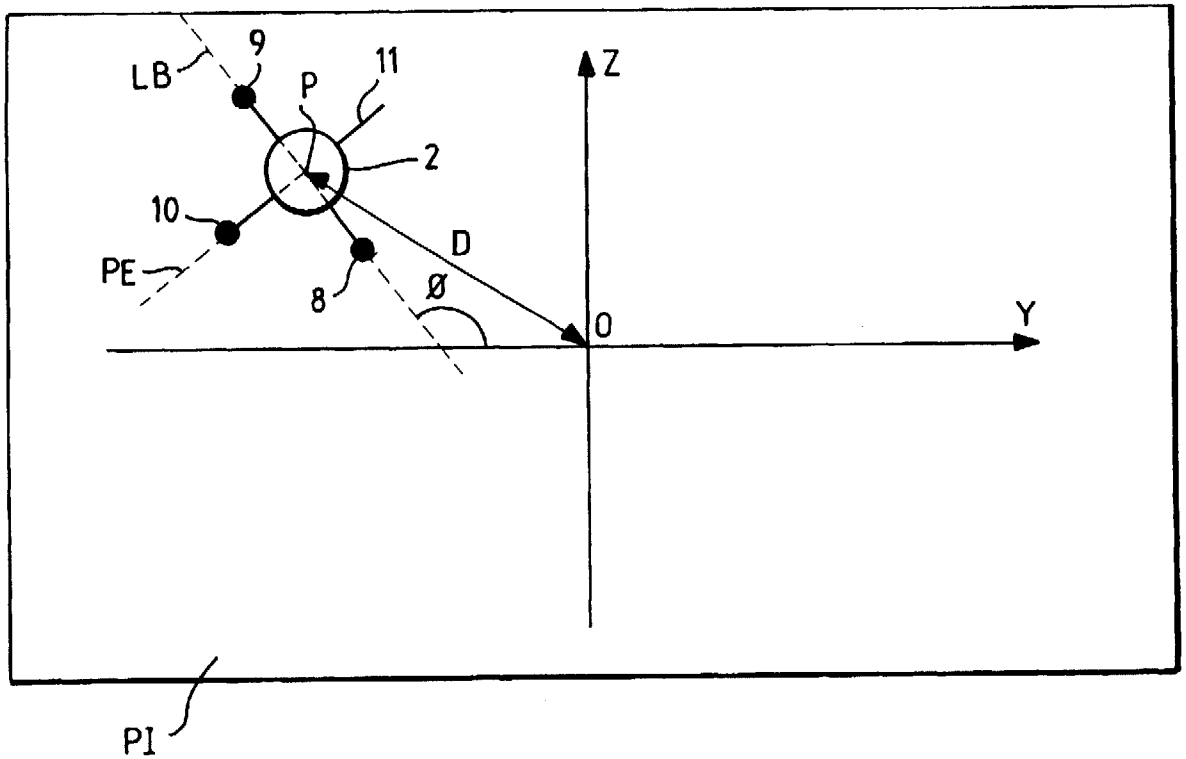
FIG. 2 represents a picture showing the moving body and enabling the implementation of the invention to be illustrated.

According to the invention, the computer 4 determines the roll angle and the position of the missile 2 from the position of said optical elements 8, 9 and 10 in such a picture PI, as shown in FIG. 2.

For this purpose, a reference-axis system OYZ is established in said picture PI, this reference-axis system being defined in the plane of the matrix 12 and such that:

the axis OY corresponds to the baseline LB passing through the optical elements 8 and 9 in a picture of the missile 2 when the latter has no roll; and the axis OZ is perpendicular to the axis OY.

Consequently, according to the invention, in order to determine the roll angle of the missile 2, the angle $\phi$ between said axis OY and the baseline LB defined by the optical elements 8 and 9 is determined in the picture PI. The indeterminacy of 180° which therefore exists in the roll angle is removed by the position of the optical element 10 with respect to this baseline LB.

It will be observed that, in order to explain and illustrate the position of said optical elements 8, 9 and 10 clearly, FIG. 2 also shows, in solid lines, the body of the missile 2 seen from the rear and the fins 11, although these elements are not generally visible in such a picture, only the optical elements 8, 9 and 10 appearing in reality.

Furthermore, in order to determine the position of the missile 2 with respect to the reference axis OX which is perpendicular to the plane of the picture PI and which passes through the point O shown, the distance D between said point O and the longitudinal axis L—L of the missile 2 indicated by a point P in the picture PI, is determined. Said point P corresponds to the projection of the optical element 10 on the baseline LB (along the perpendicular PE). The position of said point P in the reference-axis system OYZ therefore indicates the sought-after position of the missile 2 with respect to the reference axis OX.

Of course, when the plane formed by the three optical detectors 8, 9 and 10 on the missile 2 is parallel to the plane of the matrix 12 of the optical detector 3, this point P corresponds to the center of the optical elements 8 and 9, as shown.

Thus, by virtue of the invention, it is possible to determine the position and roll angle $\phi$ of the missile 2 simply, effectively and simultaneously.

In addition, the invention is inexpensive to implement since most of the elements of the system 1 already exist on a missile guidance system with which the system 1 is generally combined. Thus, only the optical elements 8, 9 and 10, for example simple mirrors, have specifically to be mounted and are lost after implementation of the invention has been used.

In another embodiment, not shown, the optical elements are individual emitters which emit radiation capable of being detected by the optical detector 3. These emitters may emit either continuously or at defined instants. In the latter case, it is necessary to provide synchronization, for example of the RF type, between said emitters and the electronics 15 taking the pictures.

As indicated previously, the data calculated by the system 1 may be used to guide the missile 2. Thus, the light flashes 7 are used not only for locating but also for remotely controlling the missile 2 from the firing and guidance station 3, 4, 6, 17. Notably, the present invention is particularly well suited for determining the guidance orders for a rotationally driven missile, the guidance of which is implemented by guidance devices, not shown, for example gas-generating lateral thrusters or control surfaces, which are arranged on the periphery of the missile and are activated for suitable periods of time at defined instants depending on the position and angle of rotation, that is to say the roll angle, of the missile and therefore depending on the data determined by the present invention.

We claim:

1. A system for determining the roll angle (ϕ), as well as the position with respect to a reference axis (OX), of a moving body (2) having a longitudinal axis (L—L), said system (1) including a stationary optical detector (3) capable of taking a picture (PI) of the area around said reference axis (OX) in which said moving body (2) is likely to move, which includes:

three optical elements (8, 9, 10) mounted on said moving body (2) and capable of generating light flashes (7) in the direction of said optical detector (3), a first and a second of said optical elements (8, 9), forming a baseline (LB), being mounted so as to be diametrically opposed with respect to said longitudinal axis (L—L) and the third optical element (10) being arranged on a line (PE) at least substantially perpendicular to this baseline (LB) passing through said longitudinal axis; and a computer (4) linked to said optical detector (3) and capable of determining the position and roll angle (ϕ) of said moving body (2) from the position of said optical elements (8, 9, 10) in a picture (PI) taken by said optical detector (3) which detects said light flashes (7), said roll angle (4) corresponding to the angle between said baseline (LB) and one axis (OY) of a defined reference-axis system (OYZ), the ambiguity of 180° in said roll angle being removed by the position of said third optical element (10), and the position of said moving body (2) with respect to said reference axis (OX) being obtained from the projection of the position of said third optical element (10) on said baseline (LB).

2. The system as claimed in claim 1, said moving body (2) having four fins (11) uniformly distributed over its periphery, wherein said optical elements (8, 9, 10) are arranged at the radially external ends (11A), respectively, of three of said fins (11).

3. The system as claimed in claim 1, wherein said optical elements are light-flash emitters.

4. The system as claimed in claim 1, wherein it includes a generator (6) for generating light flashes (7), which is stationarily mounted in the vicinity of said optical detector (3) and capable of emitting light flashes (7), at least in the area around said reference axis (OX), and wherein said optical elements (8, 9, 10) are light reflectors capable of reflecting the light flashes (7) received from said generator (6).

* * * * *